US007614489B2

(12) United States Patent
Guo et al.

(10) Patent No.: US 7,614,489 B2
(45) Date of Patent: Nov. 10, 2009

(54) HANDRAIL GUIDANCE FOR A PASSENGER CONVEYOR

(75) Inventors: Changsheng Guo, South Windsor, CT (US); John M. Milton-Benoit, West Suffield, CT (US); John P. Wesson, Vernon, CT (US); Foster P. Lamm, South Windsor, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 11/720,261

(22) PCT Filed: Dec. 7, 2004

(86) PCT No.: PCT/US2004/041036

§ 371 (c)(1),
(2), (4) Date: May 25, 2007

(87) PCT Pub. No.: WO2006/062516

PCT Pub. Date: Jun. 15, 2006

(65) Prior Publication Data

US 2008/0078651 A1 Apr. 3, 2008

(51) Int. Cl.
*B66B 23/24* (2006.01)

(52) U.S. Cl. ..... 198/337; 198/335

(58) Field of Classification Search ..... 198/335, 198/337

See application file for complete search history.

(56) References Cited

U.S. PATENT DOCUMENTS

| | | | | | |
|---|---|---|---|---|---|
| 4,488,631 | A * | 12/1984 | Courson | ..... | 198/335 |
| 4,946,020 | A * | 8/1990 | Rivera et al. | ..... | 198/335 |
| 5,131,520 | A * | 7/1992 | Johnson et al. | ..... | 198/335 |
| 5,226,522 | A * | 7/1993 | Johnson et al. | ..... | 198/335 |
| 7,243,775 | B2 * | 7/2007 | Novacek et al. | ..... | 198/337 |
| 2007/0175731 | A1 * | 8/2007 | Aulanko et al. | ..... | 198/337 |

OTHER PUBLICATIONS

PCT International Preliminary Report on Patentability mailed Jun. 21, 2007 for International application No. PCT/USO4/41036.

* cited by examiner

*Primary Examiner*—James R Bidwell
(74) *Attorney, Agent, or Firm*—Carlson, Gaskey & Olds PC

(57) ABSTRACT

A passenger conveyor system (20) includes a handrail assembly (30) having a guidance (40) for guiding a moving handrail (32). The example guidance includes an extrusion and presents a continuous, uninterrupted guiding surface (44) along which the handrail (32) travels. In a disclosed example, a single-piece extrusion (50) extends along an entire length of a balustrade (34). A disclosed example includes a first material forming a body of the guidance (40) and a second material (70) establishing the guiding surface (44).

16 Claims, 2 Drawing Sheets

HANDRAIL GUIDANCE FOR A PASSENGER CONVEYOR

FIELD OF THE INVENTION

This invention generally relates to passenger conveyors. More particularly, this invention relates to a guidance for a handrail of a passenger conveyor.

DESCRIPTION OF THE RELATED ART

Passenger conveyors such as escalators and travolators are well known. Passenger conveyors typically include a plurality of moving steps that carry passengers between landings at different locations within a building, for example. A handrail typically travels simultaneously with the steps so that a passenger can grab onto the handrail to brace them self while being carried by the conveyor.

Typical handrail arrangements include a guidance that is supported on a balustrade. Typical guidances are made from a plurality of preformed segments that are assembled on site where the passenger conveyor is installed. The preformed segments are usually made from bent pieces of aluminum, for example. A spring member typically facilitates securing the bent segments to the balustrade.

The typical, segmented guidance arrangement includes a plurality of joints along the length of the path followed by the handrail. These joints cause wear of the interior layer of the handrail as the handrail passes over each joint. There typically are relatively sharp edges at such joints and the constant scraping of the handrail along such joints introduces a significant cause of handrail wear.

Even though typical guidance segments include a wear strip along a guiding surface that is made of a material such as polyoxymethylene (POM), the segmented design of a typical guidance still introduces wear because of the contact between the interior of the handrail and the joints between such segments. Additionally, the traditional design requires multiple parts (i.e., the aluminum segments, the POM profile, a steel spring and a rubber liner). Accordingly, the conventional design is relatively expensive. There is a need for an improved arrangement that reduces cost and increases the service life of a handrail. This invention addresses those needs and avoids the shortcomings and drawbacks of conventional arrangements.

SUMMARY OF THE INVENTION

An example handrail guidance for a passenger conveyor includes an extrusion that presents a continuous, uninterrupted guiding surface along which a handrail can slide.

In one example, the extrusion comprises plastic. In another example, the extrusion comprises aluminum. In some examples, another material is placed along the guiding surface to provide low friction contact between a guiding surface and a handrail.

In one example, the guidance comprises a single piece that has a length that corresponds to an entire length of a balustrade.

An example method of making a guidance for a handrail of a passenger conveyor includes extruding a selected material to form the guidance. In one example, forming the guidance includes forming a continuous, uninterrupted guiding surface along the length of the guidance that corresponds to an entire length of a balustrade.

The various features and advantages of this invention will become apparent to those skilled in the art from the following detailed description of a currently preferred embodiment. The drawings that accompany the detailed description can be briefly described as follows.

DETAILED DESCRIPTION OF THE PREFERRED EMBODIMENTS

Figures 1, 2:
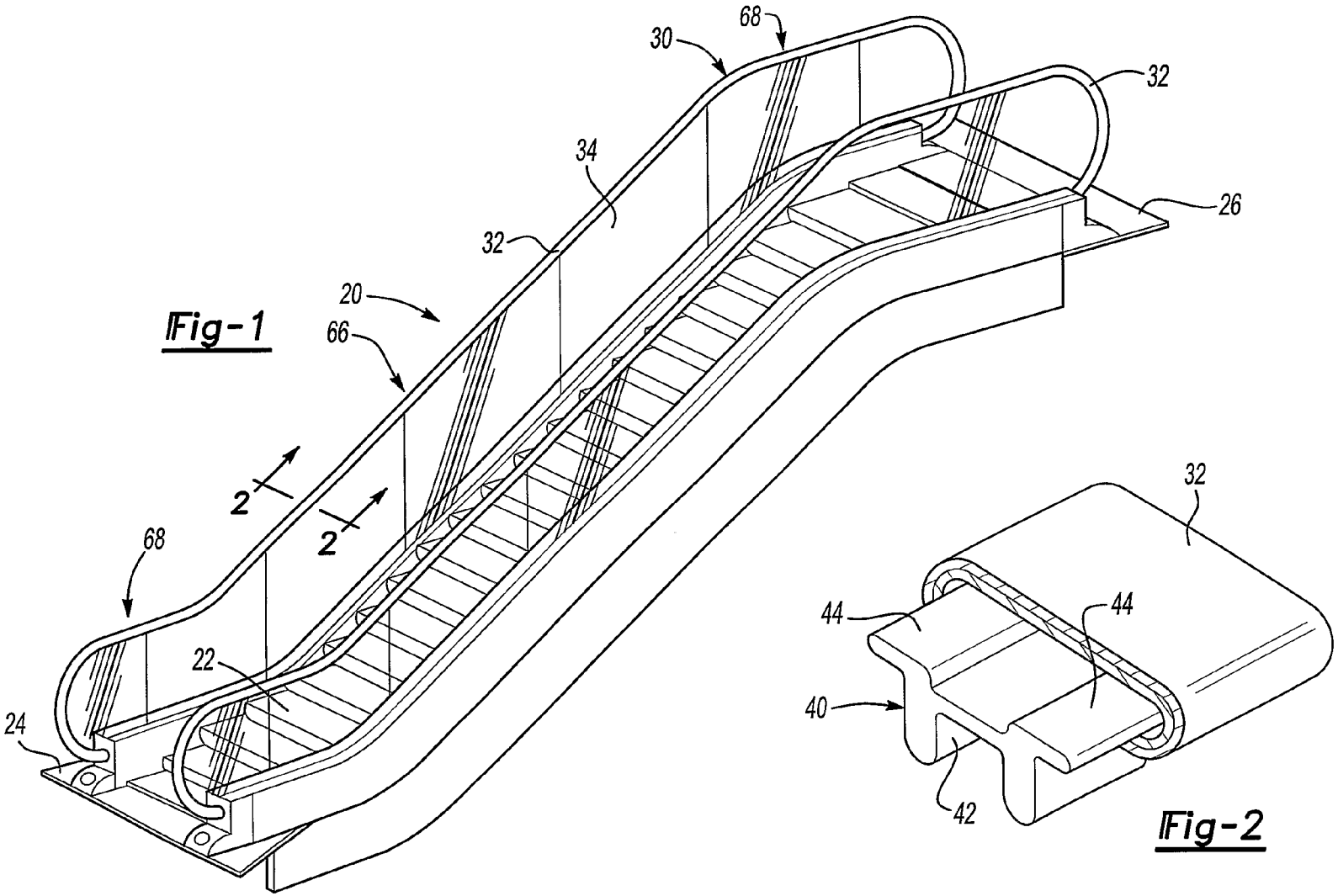
FIG. 1 diagrammatically shows an example passenger conveyor.
FIG. 2 is a perspective illustration of an example handrail and guidance assembly.

FIG. 1 shows a passenger conveyor 20 that includes a plurality of steps 22 for carrying passengers between landings 24 and 26. The example of FIG. 1 shows an escalator that is capable of carrying passengers between landings at different levels within a building. This invention is not limited to escalators and is equally applicable to other passenger conveyors such as moving walkways.

The passenger conveyor system 20 includes a handrail assembly 30 that passengers can use to brace themselves as they ride on the passenger conveyor. The example handrail assembly 30 includes a moving handrail 32 that follows the steps 22 in a known manner. The handrail 32 moves relative to a balustrade 34 that keeps the handrail 32 at a selected height relative to the steps 22.

FIG. 2 schematically shows one example guidance 40 for guiding the moving handrail 32 along the balustrade 34. In this example, a groove 42 of the guidance 40 is received over a corresponding portion of the balustrade 34. The guidance 40 includes a guiding surface 44 along which the handrail 32 slides as the handrail 32 follows the steps 22. In one example, a method of making the guidance 40 includes extruding a selected material to form the guidance 40. One example guidance 40 comprises plastic. Another example guidance 40 comprises aluminum.

Figure 3:
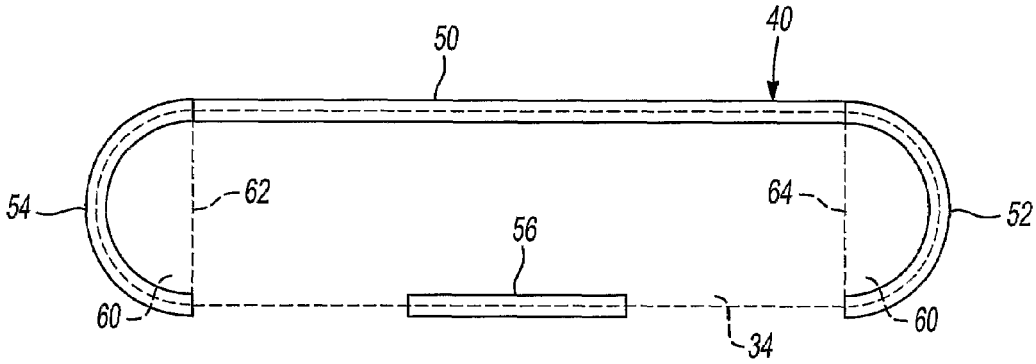
FIG. 3 schematically illustrates an example arrangement of guidance components.

An advantage to utilizing an extrusion for the guidance 40 includes being able to provide a continuous, uninterrupted guiding surface 44 along a substantial length of the travel of the handrail 32 as the handrail 32 follows a path to move with the steps 22. FIG. 3 shows one example arrangement where the guidance 40 includes a first extrusion 50 that is substantially straight. A second extrusion 52 and a third extrusion 54 are positioned adjacent each end of the first extrusion 50. Another extrusion 56 is positioned along the so-called return path of the handrail 32. In the example of FIG. 3, turn around sections 60 provide support for the second and third extrusions 52 and 54. The balustrade 34 in this example has edges at 62 and 64, which may be referred to as newel locations. In this example, the length of the balustrade 34 corresponds to the length extending between the newel locations 62 and 64.

The first extrusion 50 in the example of FIG. 3 has a length that corresponds to the entire length of the balustrade 34. An advantage to such an arrangement is that the first extrusion 50 has no joints or interruptions along the length of travel of the handrail 32 where a passenger is most likely to grasp the handrail. The first extrusion 50 presents a continuous, uninterrupted guiding surface 44 along the entire length of the balustrade 34, which greatly reduces the possibility of wear of the inside layer of the handrail 32.

In many known escalators, the balustrade includes a straight incline portion 66 with straight transition portions 68 at each end of the incline portion between the incline portion 66 and the turn around sections 60 (see FIGS. 1 and 3). One example guidance made according to this invention has a continuous extrusion over the incline and the transition portions 66 and 68. Another example includes a continuous extrusion over the incline portion 66 with separate extrusions over the transition portions 68.

In the example of FIG. 3, the second and third extrusions 54 are generally curvilinear so that the handrail 32 follows a loop for continuous movement along with the steps 22. In one example, the second and third extrusions 52 and 54 are relatively flexible and formed about the turn around sections 60 at the installation site. In another example, the extrusions 52 and 54 are rigid. In the example of FIG. 3 there are joints between the first extrusion 50, the second extrusion 52 and the third extrusion 54. Having only two such joints presents a substantial improvement compared to conventional arrangements where a plurality of guidance segments were used and a higher number of joints exist along the travel path of the handrail.

Figure 4:
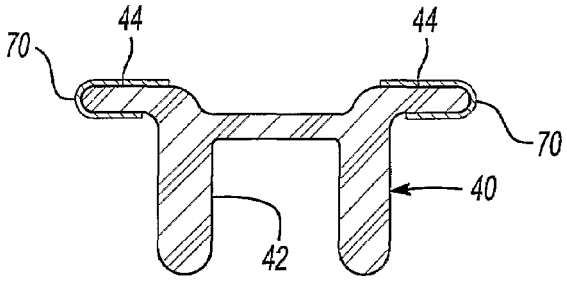
FIG. 4 is an end view of an example guidance.

FIG. 4 schematically shows one example guidance 40 that is made from a first material. A second material layer 70 establishes the guiding surface 44. In one example, the second material layer 70 comprises steel strips that are clipped on top of the body of the guidance 40. In another example a low friction material is applied to the guidance body 40 using a suitable coating technique, for example. In one example, the second material layer 70 is co-extruded at the same time of extruding the body of the guidance 40.

In one example, the second material layer 70 presents the continuous, uninterrupted guiding surface. The body of the guidance 40 may have joints or be formed of extruded segments in such an example. The continuous, uninterrupted guiding surface 44 established by the second material layer 70 renders such joints inconsequential as they will not contribute to handrail wear.

Figure 5:
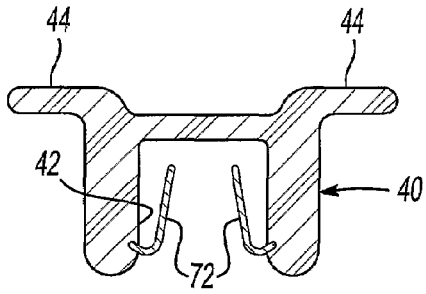
FIG. 5 is an end view of another example guidance arrangement.

FIG. 5 schematically shows an arrangement for securing an example guidance 40 to a balustrade 34. In this example, a retention element 72, such as a steel spring, is received within the groove 42. The retention element 72 provides a secure placement of the guidance 40 onto the balustrade 34.

Figure 6:
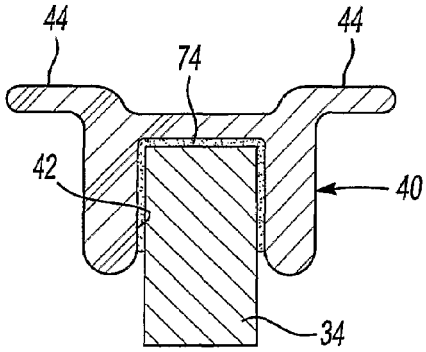
FIG. 6 is an end view schematically showing another example guidance.

FIG. 6 schematically shows another arrangement where an adhesive layer 74 secures the guidance 40 to a balustrade 34. The adhesive layer 74 may be applied to the balustrade 34 or the groove 42, depending on the particular materials selected.

Figure 7:
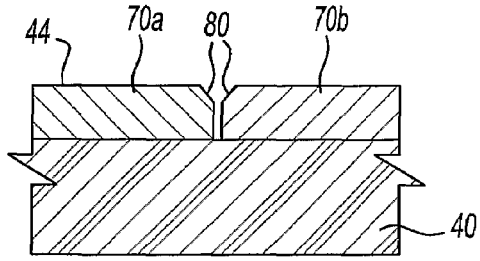
FIG. 7 is a side view showing a selected feature of another example guidance.

FIG. 7 illustrates another feature of an example arrangement where there are joints between portions of the overall guidance 40. In this example, the second material layer 70 comprises steel strips secured to a body of the guidance 40. The ends of steel strips 70A and 70B include at least one chamfered edge 80 that smoothes the interface at the joints to reduce wear of the handrail 32. The chamfered edges 80 may have an angular profile or a curvilinear profile to meet the needs of a particular situation.

The disclosed examples provide a more economical handrail guidance. Using an extrusion method for forming the guidance provides manufacturing economies and enhances the service life of a handrail assembly by reducing the possibility for wear on the internal surface of the handrail.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A handrail guidance for a passenger conveyor, comprising:

an extruded plastic guidance having a guidance body comprising a first material and a second, different material layer along the guidance body forming a continuous, uninterrupted guiding surface along which a handrail can slide, wherein the second material layer is co-extruded with the guidance body.

2. The handrail guidance of claim 1, wherein the guidance body includes a first, straight extrusion having a length corresponding to at least a straight portion of a balustrade length, a second, curvilinear extrusion adapted to be near one end of the first extrusion and a third, curvilinear extrusion adapted to be near an opposite end of the first extrusion.

3. The handrail guidance of claim 2, wherein at least the second and third extrusions are rigid.

4. The handrail guidance of claim 1, wherein the guiding surface comprises a low friction material.

5. The handrail guidance of claim 1, wherein the second material layer has first and second ends and each end includes a chamfered edge.

6. The handrail guidance of claim 1, wherein the second material layer includes steel strips that are secured on an external surface of the guidance body.

7. The handrail guidance of claim 1, wherein the guidance body comprises a plurality of segments.

8. The handrail guidance of claim 1, wherein the guidance body comprises a plurality of joints.

9. A handrail guidance for a passenger conveyor, comprising:

an extruded plastic guidance having a guidance body comprising a first material and a second, different material layer along the guidance body forming a continuous, uninterrupted guiding surface along which a handrail can slide, wherein the second material layer includes steel strips that are secured on an external surface of the guidance body.

10. The handrail guidance of claim 9, wherein the guidance body includes a first, straight extrusion having a length corresponding to at least a straight portion of a balustrade length, a second, curvilinear extrusion adapted to be near one end of the first extrusion and a third, curvilinear extrusion adapted to be near an opposite end of the first extrusion.

11. The handrail guidance of claim 10, wherein at least the second and third extrusions are rigid.

12. The handrail guidance of claim 9, wherein the guiding surface comprises a low friction material.

13. The handrail guidance of claim 9, wherein the second material layer is co-extruded with the guidance body.

14. The handrail guidance of claim 9, wherein the second material layer has first and second ends and each end includes a chamfered edge.

15. The handrail guidance of claim 9, wherein the guidance body comprises a plurality of segments.

16. The handrail guidance of claim 9, wherein the guidance body comprises a plurality of joints.

* * * * *